US011268511B2

(12) United States Patent
Park

(10) Patent No.: US 11,268,511 B2
(45) Date of Patent: Mar. 8, 2022

(54) MOTOR DRIVEN COMPRESSOR APPARATUS INCLUDING SWING PIN

(71) Applicant: Hyundai Mobis Co., Ltd., Seoul (KR)

(72) Inventor: In Won Park, Suwon-si (KR)

(73) Assignee: Hyunda Mobis Co., Ltd., Seoul (KR)

( * ) Notice: Subject to any disclaimer, the term of this patent is extended or adjusted under 35 U.S.C. 154(b) by 170 days.

(21) Appl. No.: 16/541,836

(22) Filed: Aug. 15, 2019

(65) Prior Publication Data

US 2020/0173436 A1 Jun. 4, 2020

(30) Foreign Application Priority Data

Nov. 29, 2018 (KR) ..... 10-2018-0150890

(51) Int. Cl.
*F04C 18/02* (2006.01)
*F04C 29/00* (2006.01)

(52) U.S. Cl.
CPC ..... *F04C 18/0215* (2013.01); *F04C 29/0021* (2013.01); *F04C 29/0028* (2013.01); *F04C 29/0071* (2013.01); *F04C 2210/26* (2013.01); *F04C 2240/30* (2013.01); *F04C 2240/60* (2013.01); *F04C 2240/603* (2013.01); *F04C 2240/80* (2013.01); *F04C 2270/185* (2013.01)

(58) Field of Classification Search
CPC .... F01C 1/0215; F01C 1/0223; F01C 1/0261; F04C 2/025; F04C 18/0215; F04C 18/0223; F04C 18/0261; F04C 2240/603; F04C 29/0071; F04C 29/0021; F04C 29/0028
See application file for complete search history.

(56) References Cited

U.S. PATENT DOCUMENTS

2015/0104342 A1* 4/2015 Yamazaki ..... F04C 29/06 418/55.5
2015/0159652 A1* 6/2015 Yamazaki ..... F04C 29/0021 418/55.5
2019/0345940 A1* 11/2019 Jang ..... F04C 29/0071

FOREIGN PATENT DOCUMENTS

JP 2010-096059 4/2010
KR 10-1912695 10/2018
WO WO-2017057159 A1 * 4/2017 ..... F16D 1/02

OTHER PUBLICATIONS

Office Action dated Sep. 2, 2021, issued to Korean Patent Application No. 10-2020-0093766.

* cited by examiner

*Primary Examiner* — Laert Dounis
(74) *Attorney, Agent, or Firm* — H.C. Park & Associates, PLC

(57) ABSTRACT

The present disclosure relates to a motor driven compressor apparatus capable of reducing abrasion of an orbiting scroll by implementing decompression without a separate decompression mechanism when a compressor is driven and increasing efficiency of the compressor by adjusting the pressure of a refrigerant, wherein a flow path, which is configured to pass through a center of a cross section in a longitudinal direction, and a first pin insertion hole in one direction at which the eccentric bushing is disposed and configured to communicate with the flow path and into which a swing pin is inserted, are formed in the rotary shaft, a second pin insertion hole, into which the swing pin is inserted, is formed in the eccentric bushing in the other direction at which the rotary shaft is disposed, and the refrigerant leaks between the swing pin and the first pin insertion hole.

8 Claims, 8 Drawing Sheets

MOTOR DRIVEN COMPRESSOR APPARATUS INCLUDING SWING PIN

CROSS-REFERENCE TO RELATED APPLICATION

This application claims priority to and the benefit of Korean Patent Application No. 10-2018-0150890, filed on Nov. 29, 2018, the disclosure of which is incorporated herein by reference in its entirety.

BACKGROUND

1. Field of the Invention

The present disclosure relates to a motor driven compressor apparatus, and more specifically, to a motor driven compressor apparatus capable of reducing abrasion of an orbiting scroll by implementing decompression without a separate decompression mechanism when a compressor is driven and increasing efficiency of the compressor by adjusting the pressure of a refrigerant.

2. Discussion of Related Art

Generally, a motor driven compressor apparatus used in an air-conditioner of a vehicle inhales a working fluid evaporated from an evaporator and transfers the working fluid to a condenser by converting the working fluid into a high-temperature and high-pressure state, which is easily liquefied.

Further, the motor driven compressor apparatus includes a reciprocating type in which a part configured to compress the working fluid reciprocates to perform compression, and a rotary type in which the part configured to compress the working fluid rotates to perform compression.

The rotary type includes a vane rotary type using a rotating rotary shaft and a vane, and a scroll type using a fixed scroll and an orbiting scroll facing each other.

In the scroll type, a pair of spiral-shaped scroll wraps are engaged with each other to compress a refrigerant.

In this case, the pair of scrolls are formed of a fixed scroll which is fixed and an orbiting scroll configured perform an orbiting motion by receiving a rotating force of the rotary shaft.

Meanwhile, in order to achieve the high performance, reliability, and low noise of the motor driven compressor apparatus, it is important that the orbiting scroll, which is a moving member, sufficiently comes into close contact with the fixed scroll to prevent leakage of the refrigerant which is compressed.

Further, a hydraulic pressure (refrigerant gas or oil) is used for a method of bringing the orbiting scroll into close contact with the fixed scroll, and the above is referred to as a back pressure.

The back pressure offsets a force that causes the orbiting scroll to separate from the fixed scroll by a gas force generated by compressing the refrigerant using the orbiting scroll and the fixed scroll.

However, since an excessive back pressure increases friction loss between the orbiting scroll and the fixed scroll, an appropriate back pressure should be formed.

The back pressure is formed using a difference in flow rate between a first flow path 3 connected from a discharge chamber 1 to a back pressure chamber 2 and a second flow path 5 connected from the back pressure chamber 2 to a suction chamber 4, which are shown in FIG. 1, and a flow rate formed in each of the flow paths 3 and 5 is adjusted by a decompression mechanism 6 disposed in each of the first flow path 3 or the second flow path 5.

Meanwhile, as described above, when the decompression mechanisms 6 are installed in the scrolls of the motor driven compressor apparatus, separate members are added, and thus manufacturing costs and material costs increase.

Further, a process for installing the decompression mechanism in a narrow space and the like is necessary, and in the case of simple press-fitting or bolt fastening, a decompression amount is difficult to be controlled due to leakage occurring at a fastening surface, and thus the performance and reliability are degraded.

SUMMARY OF THE INVENTION

The present disclosure is directed to providing a motor driven compressor apparatus capable of reducing abrasion of an orbiting scroll by implementing decompression without a separate decompression mechanism when a compressor is driven and increasing efficiency of the compressor by adjusting the pressure of a refrigerant.

According to an aspect of the present disclosure, there is provided a motor driven compressor apparatus including: a housing having a suction chamber into which a refrigerant is introduced and a discharge chamber from which the introduced refrigerant is compressed and discharged; a center plate fixed to an inside of the housing; a driving part fixed to the inside of the housing and configured to generate rotating power; a rotary shaft rotatably supported in the housing to rotate by the rotating power of the driving part; a swing pin configured to connect an eccentric bushing and the rotary shaft; the eccentric bushing eccentrically coupled to the rotary shaft and configured to orbit an orbiting scroll; the orbiting scroll disposed in one direction of the eccentric bushing and orbited by the rotary shaft; and a fixed scroll disposed in one direction of the orbiting scroll and in which the orbiting scroll orbits therein, wherein a flow path, which passes through a center in a cross section in a longitudinal direction, and a first pin insertion hole, which communicates with the flow path in one direction at which the eccentric bushing is disposed and into which the swing pin is inserted, are formed in the rotary shaft, a second pin insertion hole, into which the swing pin is inserted, is formed in the eccentric bushing in the other direction at which the rotary shaft is disposed, and the refrigerant leaks between the swing pin and the first pin insertion hole.

The motor driven compressor apparatus may further include a back pressure chamber surrounded by the center plate between the center plate and the orbiting scroll.

An outer diameter of the swing pin is formed to be less than an inner diameter of the first pin insertion hole and the same as an inner diameter of the second pin insertion hole, and thus an outer circumferential surface in the other end direction may be slidably coupled to the first pin insertion hole and an outer circumferential surface in one end direction may come into surface contact with and be fixed to an inner circumferential surface of the second pin insertion hole.

The outer diameter of the swing pin is formed to be the same as the inner diameter of the first pin insertion hole and less than the inner diameter of the second pin insertion hole, and thus the outer circumferential surface in the other end direction may come into surface contact with an inner circumferential surface of the first pin insertion hole, the outer circumferential surface in one end direction may be slidably coupled to the second pin insertion hole, and the first pin insertion hole may have a hole flow path groove formed therein along a longitudinal direction thereof.

The outer diameter of the swing pin is formed to be the same as the inner diameter of the first pin insertion hole and less than the inner diameter of the second pin insertion hole, and thus the outer circumferential surface in the other end direction may come into surface contact with the inner circumferential surface of the first pin insertion hole, the outer circumferential surface in one end direction may be slidably coupled to the second pin insertion hole, and the swing pin may have a pin flow path groove formed therein along a longitudinal direction thereof.

The first pin insertion hole and the flow path may be formed on different center lines.

The orbiting scroll may be include a disc-shaped orbiting scroll end plate which is vertically disposed and spiral-shaped orbiting scroll wraps configured to protrude from one surface of the orbiting scroll end plate in a horizontal direction.

The fixed scroll may include a disc-shaped fixed scroll end plate which is vertically disposed; a discharge port configured to pass through a center of the fixed scroll end plate from one surface to the other surface; a valve disposed on one cross section of the fixed scroll end plate to selectively open and close the discharge port; a wall configured to protrude to an outer circumferential surface in the other surface direction of the fixed scroll end plate in a horizontal direction; and spiral-shaped fixed scroll wraps configured to protrude from the other surface of the fixed scroll end plate in a horizontal direction to be alternately inserted into the orbiting scroll wraps at an angle of 180°.

The motor driven compressor apparatus may further include compressing chambers formed to be surrounded by the orbiting scroll end plate, the orbiting scroll wraps, the fixed scroll end plate, and the fixed scroll wraps and in which the refrigerant and oil are compressed by rotation of the orbiting scroll.

A first refrigerant collecting hole configured to allow one surface of the center plate and the back pressure chamber to communicate with each other may be formed in the center plate, and a second refrigerant collecting hole, which is formed between the discharge chamber disposed in one end direction of the fixed scroll and the first refrigerant collecting hole to allow the discharge chamber and the first refrigerant collecting hole to communicate with each other, may be formed in the wall.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Advantages and characteristics of the present disclosure, and a method of achieving the above, will be apparent with reference to embodiments which will be described in detail with the accompanying drawings. However, the present disclosure is not limited to the embodiments which will be described below and may be implemented in different forms. The embodiments are only provided to completely disclose the present disclosure and completely convey the scope of the present disclosure to those skilled in the art, and the present disclosure is defined by the disclosed claims. Meanwhile, terms used in the description are provided not to limit the present disclosure but to describe the embodiments. In the embodiment, the singular form is intended to also include the plural form unless the context clearly indicates otherwise. The terms "comprise" and/or "comprising" as used herein do not preclude the presence or addition of at least one other element, step, operation, and/or element other than the stated components, steps, operations and/or elements.

Hereinafter, preferable embodiments of the present disclosure will be described in detail with reference to the accompanying drawings.

Figure 1:
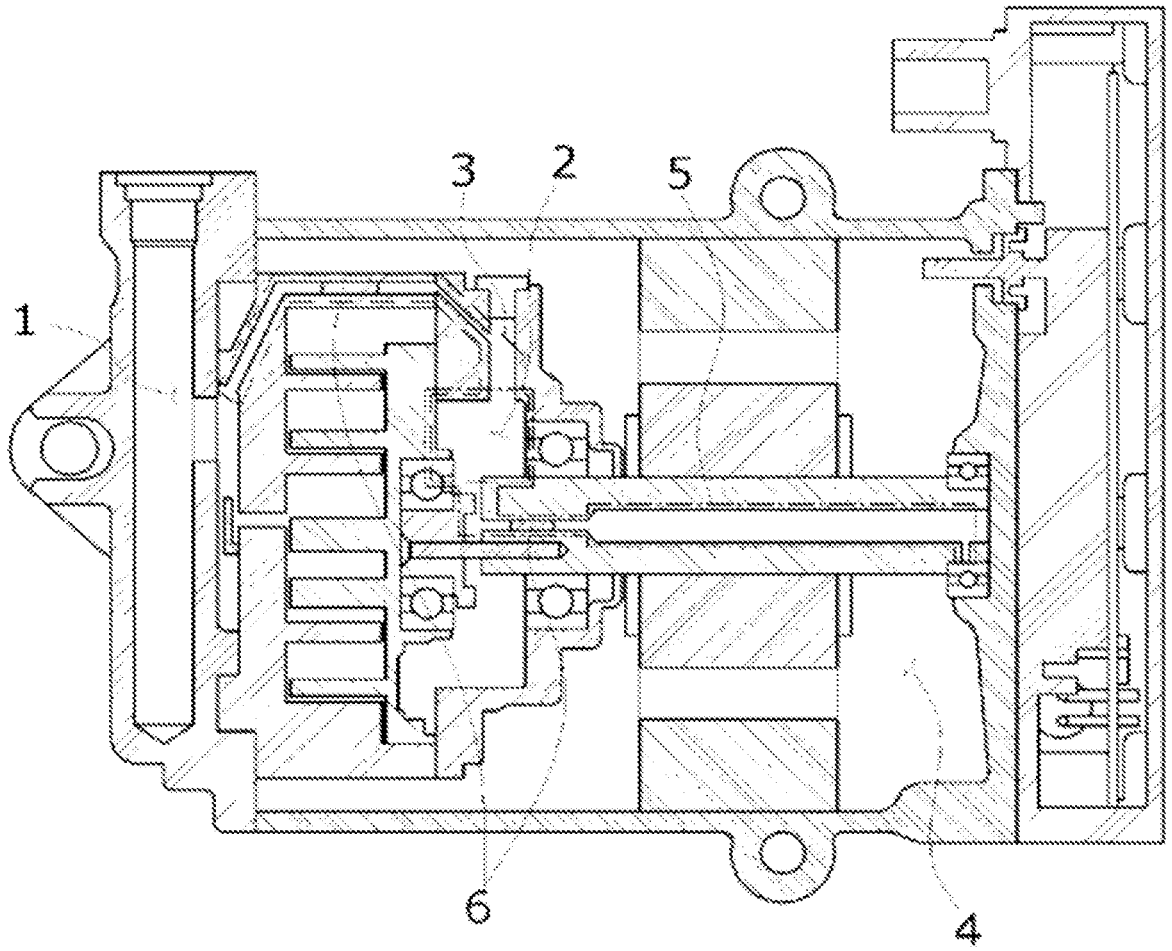
PRIOR ART FIG. 1
FIG. 1 is a cross-sectional view illustrating a motor driven compressor apparatus according to the related art.
Figure 2:
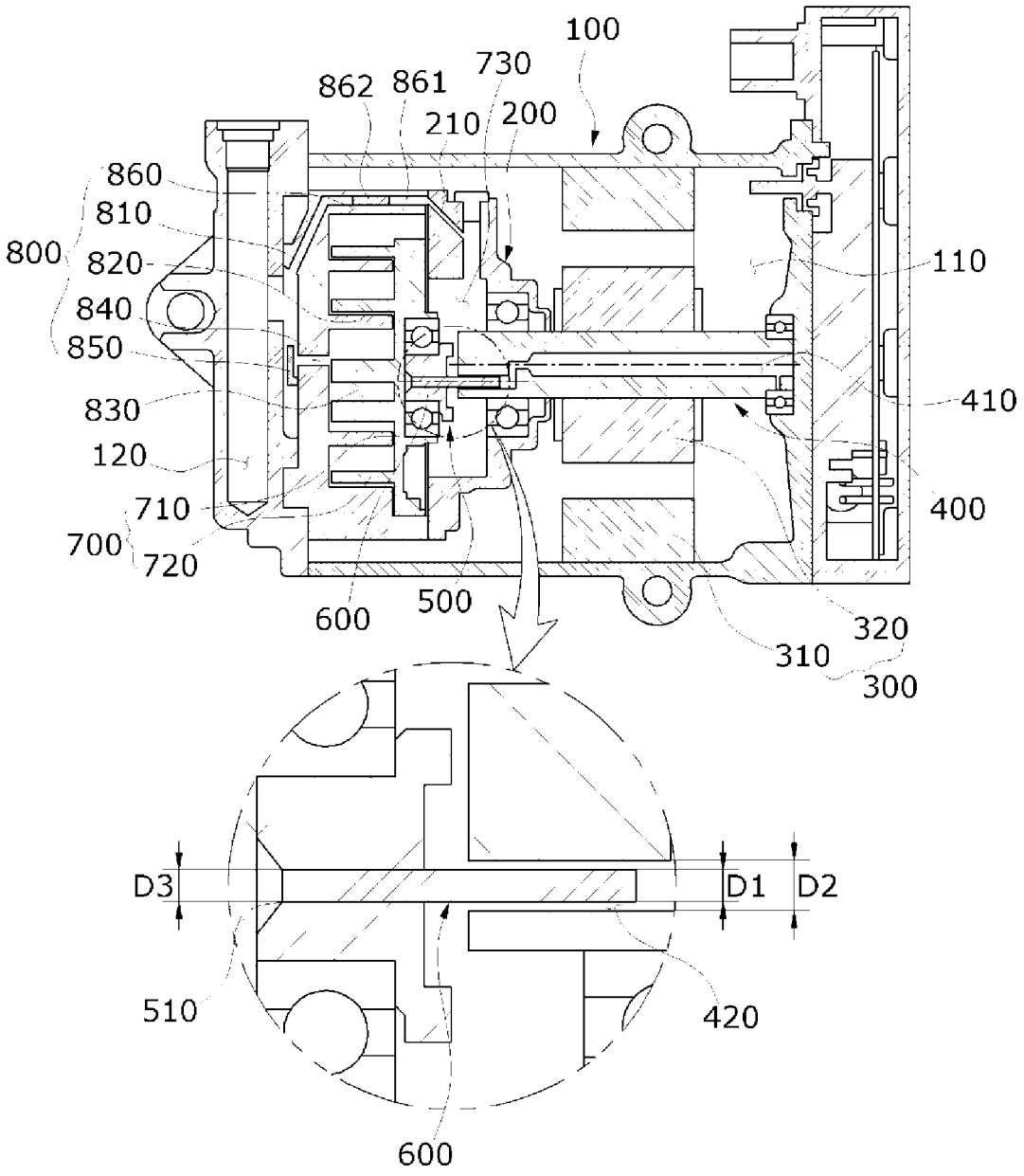
FIG. 2 is a cross-sectional view illustrating a motor driven compressor apparatus according to an embodiment of the present disclosure.
Figure 3A:
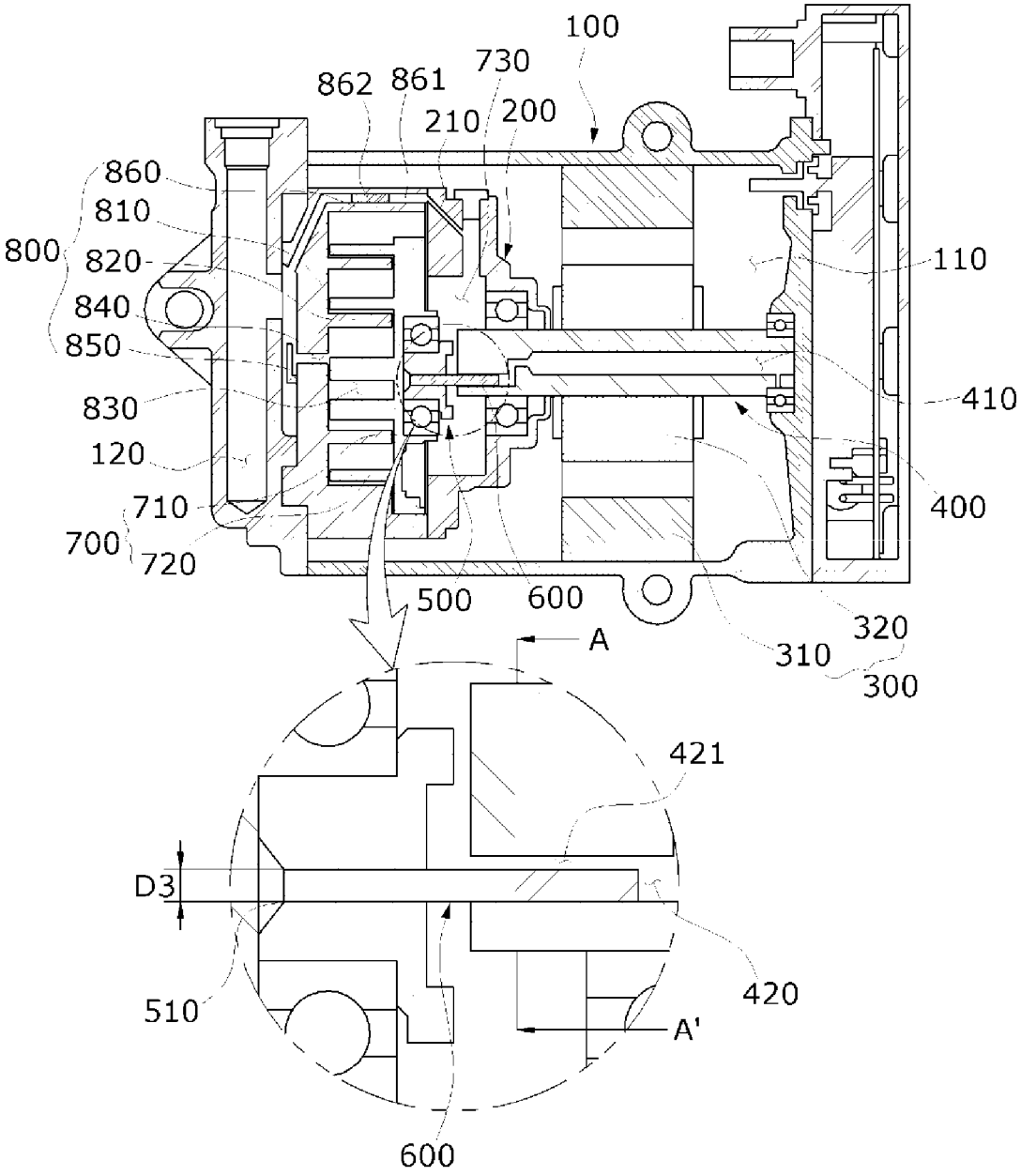
FIG. 3A is a cross-sectional view illustrating a motor driven compressor apparatus according to another embodiment of the present disclosure.
Figure 3B:
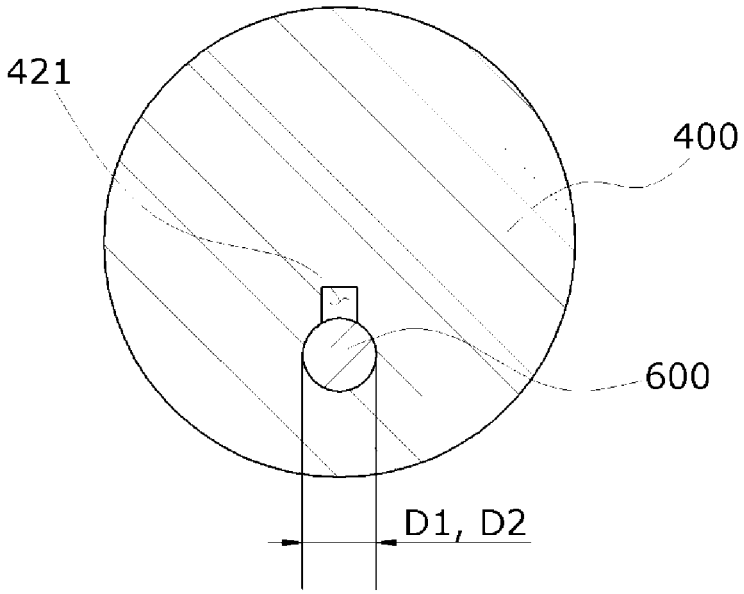
FIG. 3B is a cross-sectional view taken along line A-A' in FIG. 3A.
Figure 4A:
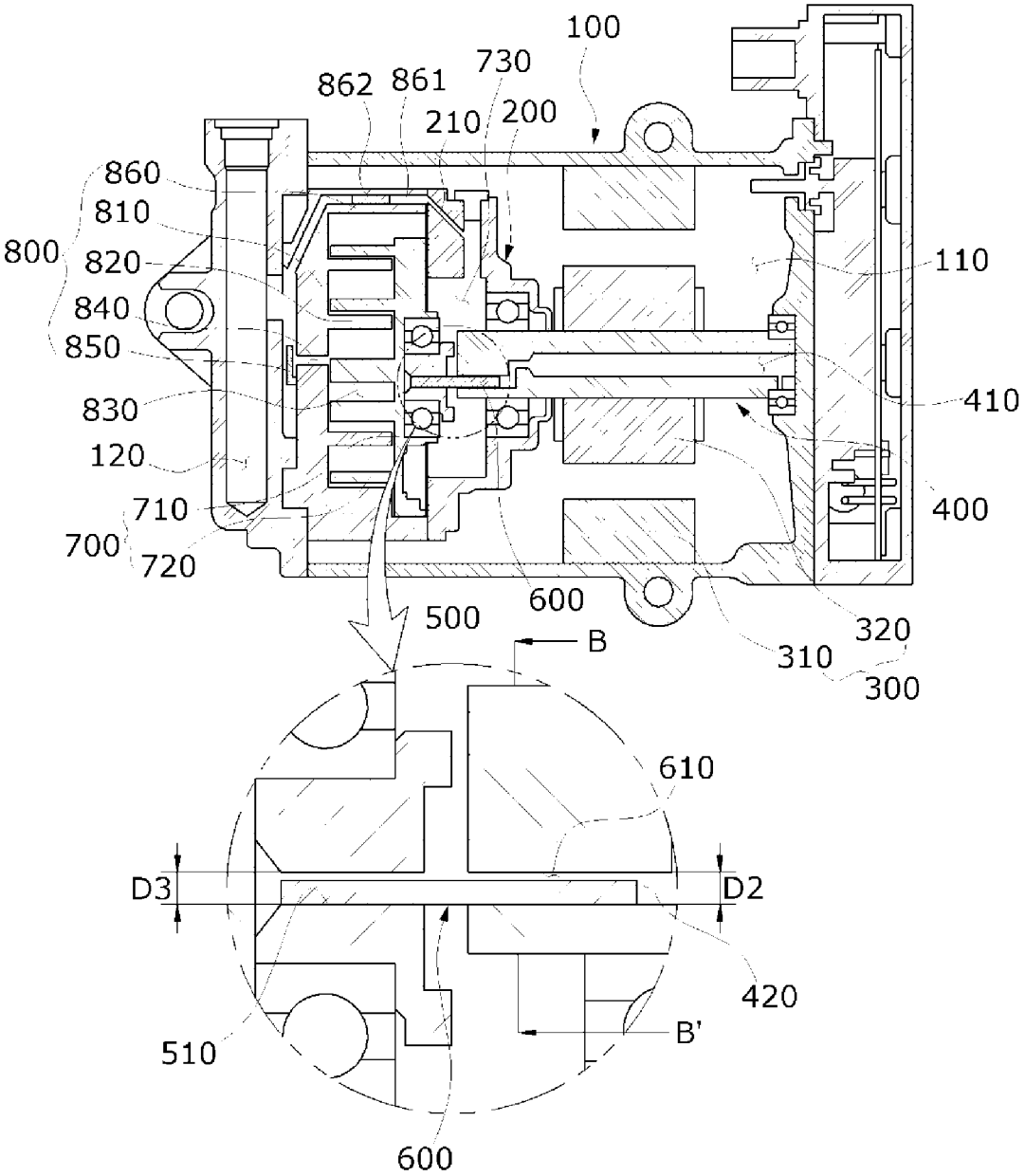
FIG. 4A is a cross-sectional view illustrating a motor driven compressor apparatus according to still another embodiment of the present disclosure.
Figure 4B:
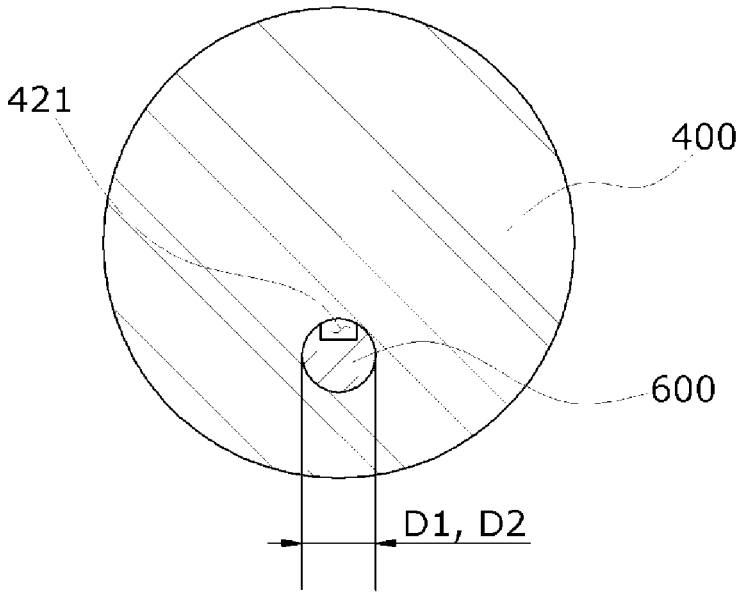
FIG. 4B is a cross-sectional view taken along line B-B' in FIG. 4A.
Figure 5:
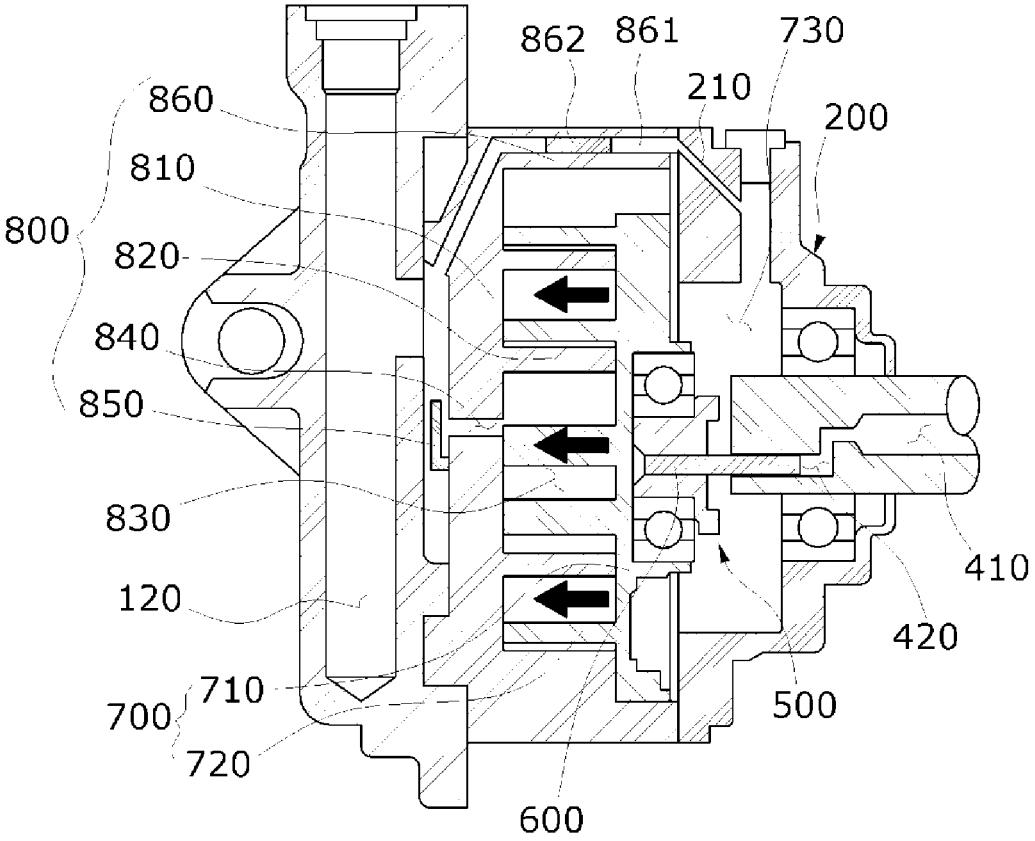
FIG. 5 is a cross-sectional view illustrating a moving state of an orbiting scroll according to an embodiment of the present disclosure.
Figure 6:
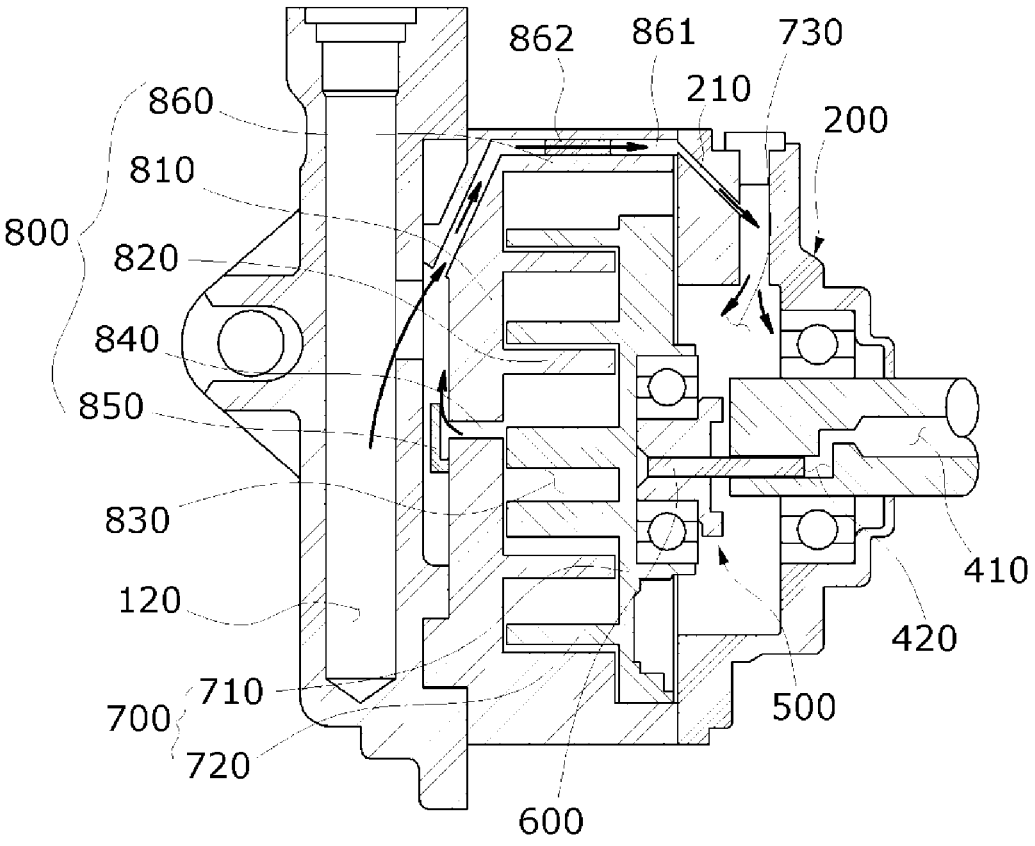
FIG. 6 is an operational view illustrating an operation state of a valve according to an embodiment of the present disclosure.

FIG. 2 is a cross-sectional view illustrating a motor driven compressor apparatus according to an embodiment of the present disclosure, FIG. 3A is a cross-sectional view illustrating a motor driven compressor apparatus according to another embodiment of the present disclosure, FIG. 3B is a cross-sectional view taken along line A-A' in FIG. 3A, FIG. 4A is a cross-sectional view illustrating a motor driven compressor apparatus according to still another embodiment of the present disclosure, FIG. 4B is a cross-sectional view taken along line B-B' in FIG. 4A, FIG. 5 is a cross-sectional view illustrating a moving state of an orbiting scroll according to an embodiment of the present disclosure, and FIG. 6 is an operational view illustrating an operation state of a valve according to an embodiment of the present disclosure.

The motor driven compressor apparatus according to the embodiment includes a housing 100, a center plate 200, a driving part 300, a rotary shaft 400, an eccentric bushing 500, an orbiting scroll 700, a fixed scroll 800, and a swing pin 600.

A suction chamber 110, into which a low-pressure refrigerant is introduced from the outside, and a discharge chamber 120, in which the introduced refrigerant is compressed and discharged, are formed in an outer surface of the housing 100, and the housing 100 forms an exterior of the motor driven compressor apparatus according to the present disclosure.

Further, the housing 100 protects components such as the center plate 200, the driving part 300, the rotary shaft 400, and the like from an external force and solidly supports the above-described components accommodated therein.

The center plate 200 is fixed to the inside of the housing 100 and supports the rotary shaft 400 rotatably fixed to the inside of the housing 100.

A first refrigerant collecting hole 210 is formed in the center plate 200.

As shown in FIG. 2, the first refrigerant collecting hole 210 is formed in one surface of the center plate 200 and communicates with an inner circumferential surface of the center plate 200 forming a back pressure chamber 730 to serve to transfer the refrigerant to the back pressure chamber 730 which is a space between the orbiting scroll 700 and the center plate 200.

The driving part 300 is fixed to the inside of the housing 100 and generates rotating power to rotate the rotary shaft 400 as a driving source configured to generate the rotating power of a compressor.

The driving part 300 includes a stator 310 and a rotor 320.

The stator 310 may be formed of a kind of electromagnet and is fixed to an inner circumferential surface of the housing 100 by press fitting or the like.

Further, the stator 310 is a hollow cylindrical member and a through hole into which the rotor 320 is inserted is formed on a center axis of the stator 310.

The rotor 320 is a part which is coaxially mounted in the stator 310 and rotatably driven, and is rotatably inserted into the through hole in a center of the stator 310.

Further, the rotor 320 is provided to rotate the rotary shaft 400 by interaction with the stator 310 and is rotationally driven by interaction with the stator 310 according to a driving principle of a motor when the stator 310 is excited.

Accordingly, the rotary shaft 400 is rotatably supported by the center plate 200 and the housing 100 through a bearing to be easily rotatable by the rotor 320.

The rotary shaft 400 is rotatably supported on an inner surface in the other end direction of the housing 100 through a center of the center plate 200, is mounted in the housing 100, and rotates by the rotating power from the driving part 300 mounted on an outer circumferential surface of the rotor 320.

A flow path 410 and a first pin insertion hole 420 are formed in the rotary shaft 400.

The flow path 410 is formed at a center of a cross section of the rotary shaft 400 along a longitudinal direction and is a path through which the refrigerant in the back pressure chamber 730 is discharged to the outside of the rotary shaft 400.

The first pin insertion hole 420 is formed in a side surface in one direction of the rotary shaft 400, on which the eccentric bushing 500 is disposed, and communicates with flow path 410.

Accordingly, the refrigerant of the back pressure chamber 730 may easily flow to the flow path 410 through the first pin insertion hole 420.

Further, the swing pin 600 which will be described later is inserted into the first pin insertion hole 420.

Particularly, as shown in FIG. 2, the first pin insertion hole 420 and the flow path 410 are formed on different center lines.

Accordingly, the first pin insertion hole 420 may eccentrically couple the eccentric bushing 500, which is coupled to the rotary shaft 400, to the rotary shaft 400.

The eccentric bushing 500 is provided to balance according to eccentric rotation of the orbiting scroll 700 coupled thereto and is coupled to the rotary shaft 400, more specifically, the first pin insertion hole 420 eccentrically formed in one end direction of the rotary shaft 400.

The eccentric bushing 500 is rotatably coupled to the orbiting scroll 700, and the other surface of the eccentric bushing 500 is pin-coupled to the rotary shaft 400 through the swing pin 600.

The eccentric bushing 500 forms a second pin insertion hole 510.

The second pin insertion hole 510 is formed in the other direction in which the rotary shaft 400 is disposed, and the swing pin 600 is inserted into the second pin insertion hole 510.

The swing pin 600 is provided to interconnect the eccentric bushing 500 and the rotary shaft 400 and serves to prevent more contact between the scrolls when the orbiting scroll 700 rotates once together with the second pin insertion hole 510.

The other end of the swing pin 600 is inserted into the rotary shaft 400 through the first pin insertion hole 420, and one end of the swing pin 600 is inserted into the eccentric bushing 500 through the second pin insertion hole 510.

Meanwhile, when the refrigerant introduced into the back pressure chamber 730 through the first refrigerant collecting hole 210 does not flow out, since an inner pressure of the back pressure chamber 730 increases to a pressure the same as or similar to a discharge pressure, the orbiting scroll 700 floats excessively in one direction and thus operation efficiency of the compressor may be lowered.

In order to prevent the above, an outer diameter D1 of the swing pin 600 is formed to be less than an inner diameter D2 of the first pin insertion hole 420 and the same as an inner diameter D3 of the second pin insertion hole 510.

Further, in the swing pin 600, an outer circumferential surface at the other end is slidably coupled to the first pin insertion hole 420, and an outer circumferential surface at one end comes into surface contact with and is fixed by a press-fitting manner to an inner circumferential surface of the second pin insertion hole 510.

That is, the refrigerant in the back pressure chamber 730 may leak through a space between outer circumferential surface at the other end of the swing pin 600 and an inner circumferential surface of the first pin insertion hole 420.

Accordingly, a space between the outer circumferential surface of the swing pin 600 and the inner circumferential surface of the first pin insertion hole 420 may drop the pressure of the back pressure chamber 730 to a pressure similar to the pressure of the suction chamber 110 to discharge the refrigerant introduced into the back pressure chamber 730 from the discharge chamber 120 through the first refrigerant collecting hole 210.

Meanwhile, the pressure of the back pressure chamber 730 is determined according to a size of the space between the outer circumferential surface of the swing pin 600 and the inner circumferential surface of the first pin insertion hole 420.

Accordingly, an optimum back pressure according to each driving condition of a compressor apparatus is maintained to optimize the performance of the compressor.

Accordingly, in the motor driven compressor apparatus of the present disclosure, since a separate decompression mechanism in the flow path 410 through which the refrigerant leaks to the rotary shaft 400 from the back pressure chamber 730 is removed, manufacturing costs and material costs may be reduced.

Further, since a process of installing the decompression mechanism in a narrow space is removed, manufacturing and decompression force managing are facilitated, and back pressure performance and reliability may be improved.

In another embodiment of the present disclosure, as shown in FIGS. 3A and 3B, an outer diameter D1 of a swing pin 600 is formed to be the same as an inner diameter D2 of a first pin insertion hole 420 and less than an inner diameter D3 of a second pin insertion hole 510.

Further, in the swing pin 600, an outer circumferential surface at the other end comes into surface contact with and is fixed by a press-fitting manner to an inner circumferential surface of the first pin insertion hole 420, and an outer circumferential surface at one end is slidably coupled to an inner circumferential surface of the second pin insertion hole 510.

A hole flow path groove 421 is formed in the first pin insertion hole 420 along a longitudinal direction.

Accordingly, a refrigerant in a back pressure chamber 730 may leak into the hole flow path groove 421 such that the pressure of the back pressure chamber 730 is not excessively increased.

Meanwhile, a plurality of hole flow path grooves 421 may be formed to be spaced apart from each other by a distance along the inner circumferential surface of the first pin insertion hole 420 as long as the intermediate pressure refrigerant introduced from the back pressure chamber 730 may easily leak.

In still another embodiment of the present disclosure, as shown in FIGS. 4A and 4B, like another embodiment of the present disclosure, an outer diameter D1 of a swing pin 600 is formed to be the same as an inner diameter D2 of a first pin insertion hole 420 and less than an inner diameter D3 of a second pin insertion hole 510.

Further, in the swing pin 600, an outer circumferential surface at the other end comes into surface contact with and is fixed by a press-fitting manner to an inner circumferential surface of the first pin insertion hole 420, and an outer circumferential surface at one end is slidably coupled to an inner circumferential surface of the second pin insertion hole 510.

However, unlike another embodiment of the present disclosure, in still another embodiment of the present disclosure, a pin flow path groove 610 is formed at the other end direction of the swing pin 600 which comes into contact with the inner circumferential surface of the first pin insertion hole 420.

Accordingly, a refrigerant in a back pressure chamber 730 may leak into the pin flow path groove 610 such that the pressure of the back pressure chamber 730 is not excessively increased.

Meanwhile, a plurality of pin flow path grooves 610 may be formed to be spaced apart from each other by a distance along an outer circumferential surface of the swing pin 600 as long as the intermediate pressure refrigerant introduced from the back pressure chamber 730 may easily leak.

An orbiting scroll 700 is disposed in one direction of an eccentric bushing 500 and is fixed to a rotary shaft 400 through the eccentric bushing 500, and orbits by a rotating force of the rotary shaft 400.

The orbiting scroll 700 includes an orbiting scroll end plate 710, an orbiting scroll wrap 720, and a back pressure chamber 730.

The orbiting scroll end plate 710 is formed in a vertically arranged disc shape and is accommodated in a housing 100 to be disposed in one direction of the eccentric bushing 500.

Further, the orbiting scroll end plate 710 is fixed to the rotary shaft 400 and configured to rotate by a rotation driving force generated from a driving part 300 through the eccentric bushing 500.

A plurality of orbiting scroll wraps 720 protrude from one surface of the orbiting scroll end plate 710 in a horizontal direction and are formed in a spiral shape.

Meanwhile, a length of the orbiting scroll wrap 720 is formed at a distance in which one end portion of the orbiting scroll wrap 720 may be spaced apart from the other surface of a fixed scroll wrap 820 in a state in which a compressor does not operate.

Further, when the compressor operates and thus the orbiting scroll 700 orbits, as shown in FIG. 5, the orbiting scroll end plate 710 floats toward the fixed scroll 800, and accordingly, one end portion of the orbiting scroll wrap 720 comes into contact with the other surface of the fixed scroll 800.

The back pressure chamber 730 is formed to be surrounded by the orbiting scroll end plate 710 and the center plate 200, and the intermediate pressure refrigerant is formed in the back pressure chamber 730.

Accordingly, when the compressor operates, the orbiting scroll 700 floats in one direction by the pressure of the refrigerant introduced into the back pressure chamber 730.

The fixed scroll 800 is disposed in one direction of the orbiting scroll 700, and the orbiting scroll 700 orbits in the fixed scroll 800.

The fixed scroll 800 includes a fixed scroll end plate 810, a fixed scroll wrap 820, a discharge port 840, and a valve 850.

The fixed scroll end plate 810 is formed in a vertically arranged disc shape and is accommodated in the housing 100 to be disposed in the one direction of the orbiting scroll 700.

A plurality of fixed scroll wraps 820 protrude from the other surface of the fixed scroll end plate 810 in a horizontal direction, are each formed in a spiral shape, and are alternately inserted into the orbiting scroll wraps 720 at an angle of 180°.

Meanwhile, since the fixed scroll wraps 820 and the orbiting scroll wraps 720 are engaged with and coupled to each other, a plurality of compressing chambers 830 are formed between the fixed scroll wraps 820 and the orbiting scroll wraps 720.

The compressing chambers 830 are spaces in which the refrigerant is compressed by rotation of the orbiting scroll 700, and when the orbiting scroll wraps 720 and the fixed scroll wraps 820 are engaged with and coupled to each other, the plurality of compressing chambers 830 are formed to be surrounded by the orbiting scroll end plate 710, the orbiting scroll wraps 720, the fixed scroll end plate 810, and the fixed scroll wraps 820.

The compressing chamber 830 causes a low-pressure refrigerant to reach a high pressure when the refrigerant is compressed by the rotation of the orbiting scroll 700.

The discharge port 840 is provided to pass through a center of the fixed scroll end plate 810 from one surface to the other surface, and is a hole through which the high-pressure refrigerant is discharged to a discharge chamber 120 from the compressing chamber 830.

The valve 850 is disposed on the other surface of the fixed scroll end plate 810 to selectively open and close the discharge port 840.

The valve 850 closes the discharge port 840 to prevent discharge of the low-pressure refrigerant to the discharge chamber 120 through the discharge port 840 until the low-pressure refrigerant formed in the compressing chamber 830 reaches a high pressure.

Further, as shown in FIG. 6, when the low-pressure refrigerant rises to a high pressure r due to operation of the driving part 300, since the valve 850 is opened by a high pressure of the refrigerant, the high-pressure refrigerant formed in the compressing chamber 830 is discharged to the discharge chamber 120 through the discharge port 840.

Accordingly, the low-pressure refrigerant formed in the compressing chamber 830 may be efficiently blocked by the valve 850 from being discharged from the compressing chamber 830 to the discharge chamber 120 through the discharge port 840 before reaching the high pressure.

A wall 860 is provided to horizontally protrude toward the other surface of the fixed scroll end plate 810 from an outer circumferential surface of the fixed scroll end plate 810.

Further, the other surface of the wall 860 comes into contact with one surface of the center plate 200.

Meanwhile, the orbiting scroll wraps 720 of the orbiting scroll 700 are accommodated between the walls 860.

In this case, a diameter of the orbiting scroll 700 may be formed to be less than an inner diameter of the wall 860.

Accordingly, when the orbiting scroll end plate 710 rotates, since damage of an outer circumferential surface of the orbiting scroll end plate 710 due to friction with an inner circumferential surface of the wall 860 does not occur, durability of the orbiting scroll 700 may be improved.

A second refrigerant collecting hole 861 is formed in the wall 860.

The second refrigerant collecting hole 861 allows the discharge chamber 120 and the first refrigerant collecting hole 210 to communicate with each other and serves to transfer the high-pressure refrigerant collected in the discharge chamber 120 to the back pressure chamber 730 through the first refrigerant collecting hole 210 due to a pressure difference.

Meanwhile, when the high pressure is directly introduced into the back pressure chamber 730, the orbiting scroll 700 floats excessively in one direction and thus the operation efficiency of the compressor may be degraded.

Accordingly, a decompression member 862 is mounted in the second refrigerant collecting hole 861.

The decompression member 862 is provided to reduce a pressure of fluids and is mounted in the second refrigerant collecting hole 861 to reduce the pressure of the high-pressure refrigerant which moves from the discharge chamber 120 to the back pressure chamber 730.

That is, the decompression member 862 may drop the pressure of the high-pressure refrigerant introduced through the second refrigerant collecting hole 861 to an intermediate pressure and transfer the refrigerant to the back pressure chamber 730.

Accordingly, the decompression member 862 may improve the operation efficiency of the compressor by forming an appropriate back pressure together with a space between the outer circumferential surface of the swing pin 600 and the inner circumferential surface of the first pin insertion hole 420, the hole flow path groove 421, or the pin flow path groove 610.

As described above, in the motor driven compressor apparatus according to the present disclosure, since the outer diameter D1 of the swing pin 600 is formed to be less than the inner diameter D2 of the first pin insertion hole 420 and the same as the inner diameter D3 of the second pin insertion hole 510, the refrigerant in the back pressure chamber 730 leaks through a space between the outer circumferential surface at the other end of the swing pin 600 and the inner circumferential surface of the first pin insertion hole 420, and a space between the outer circumferential surface at the other end of the swing pin 600 and the inner circumferential surface of the first pin insertion hole 420 is adjusted, and thus the pressure of the back pressure chamber 730 may be formed to be at appropriate intermediate pressure.

Accordingly, since the separate decompression mechanism in the flow path 410 through which the refrigerant leaks to the rotary shaft 400 from the back pressure chamber 730 is removed, the manufacturing costs and the material costs may be reduced, and since the process of installing the decompression mechanism in the narrow space is removed, manufacturing and decompression force managing are facilitated, and the back pressure performance and reliability may be improved.

Further, since the first pin insertion hole 420 is formed in the side surface in one direction of the rotary shaft 400, on which the eccentric bushing is disposed, and communicates with the flow path 410, the refrigerant in the back pressure chamber 730 may easily flow to the flow path 410.

In addition, since the first pin insertion hole 420 and the flow path 410 are formed on different center lines, the first pin insertion hole 420 may eccentrically couple the eccentric bushing 500, which is coupled to the rotary shaft 400, to the rotary shaft 400.

In addition, the valve 850 is formed on the other surface of the fixed scroll end plate 810 to selectively open or close the discharge port 840 and closes the discharge port 840 to prevent discharge of the low-pressure refrigerant to the discharge chamber 120 through the discharge port 840 until the low-pressure refrigerant formed in the compressing chamber reaches a high pressure, and thus the low-pressure refrigerant formed in the compressing chamber 830 may be efficiently blocked by the valve 850 from being discharged from the compressing chamber 830 to the discharge chamber 120 through the discharge port 840 before reaching the high pressure.

In a motor driven compressor apparatus according to the present disclosure, since an outer diameter of a swing pin is formed to be less than an inner diameter of a first pin insertion hole and the same as an inner diameter of a second pin insertion hole, a refrigerant in a back pressure chamber leaks through a space between an outer circumferential surface at the other end of the swing pin and an inner circumferential surface of the first pin insertion hole, and a space between the outer circumferential surface at the other end of the swing pin and the inner circumferential surface of the first pin insertion hole is adjusted, and thus a pressure of the back pressure chamber can be formed to be an appropriate intermediate pressure.

Accordingly, since a separate decompression mechanism in a flow path through which the refrigerant leaks to a rotary shaft from the back pressure chamber is removed, manufacturing costs and material costs can be reduced, and since a process of installing the decompression mechanism in a narrow space is removed, manufacturing and decompression force managing are facilitated, and back pressure performance and reliability can be improved.

Further, since the first pin insertion hole is formed in a side surface in one direction of the rotary shaft, on which an eccentric bushing is disposed, and communicates with the flow path, the refrigerant in the back pressure chamber can easily flow to the flow path.

In addition, since the first pin insertion hole and the flow path are formed on different center lines, the first pin insertion hole can eccentrically couple the eccentric bushing, which is coupled to the rotary shaft, to the rotary shaft.

In addition, since a valve is formed on the other surface of a fixed scroll end plate to selectively open or close a discharge port and closes the discharge port to prevent discharge of the low-pressure refrigerant to a discharge chamber through the discharge port until a low-pressure refrigerant formed in the compressing chamber reaches a high pressure, the low-pressure refrigerant formed in the compressing chamber can be efficiently blocked from being discharged from the compressing chamber to the discharge chamber through the discharge port before reaching a high pressure.

The present disclosure is not limited to the above-described embodiments and may be variously modified within the scope of the technical spirit of the present disclosure.

What is claimed is:

1. A motor driven compressor apparatus comprising:

a housing having a suction chamber into which a refrigerant is introduced and a discharge chamber from which the introduced refrigerant is compressed and discharged;

a center plate fixed to an inside of the housing;

a driving part fixed to the inside of the housing and configured to generate rotating power;

a rotary shaft rotatably supported in the housing to rotate by the rotating power of the driving part;

a swing pin configured to connect an eccentric bushing and the rotary shaft;

the eccentric bushing eccentrically coupled to the rotary shaft and configured to orbit an orbiting scroll;

the orbiting scroll disposed in one direction of the eccentric bushing and orbited by the rotary shaft;

a fixed scroll disposed in one direction of the orbiting scroll and in which the orbiting scroll orbits therein, a flow path formed in the rotary shaft, which passes through a center in a cross section in a longitudinal direction and bends within the rotary shaft, a first pin insertion hole, which forms the flow path in one direction at which the eccentric bushing is disposed and into which the swing pin is inserted, a second pin insertion hole, into which the swing pin is inserted, is formed in the eccentric bushing in the other direction at which the rotary shaft is disposed, and the refrigerant leaks between the swing pin and the first pin insertion hole, wherein an outer diameter of the swing pin is formed to be the same as an inner diameter of the first pin insertion hole and less than an inner diameter of the second pin insertion hole, and thus an outer circumferential surface of the swing pin in the one direction comes into surface contact with an inner circumferential surface of the first pin insertion hole, an outer circumferential surface in the other direction is slidably coupled to the second pin insertion hole, and the first pin insertion hole has a hole flow path groove formed therein along a longitudinal direction thereof.

2. The motor driven compressor apparatus of claim 1, further comprising a back pressure chamber surrounded by the center plate between the center plate and the orbiting scroll.

3. The motor driven compressor apparatus of claim 2, wherein the first pin insertion hole is formed on a center line different from the flow path.

4. The motor driven compressor apparatus of claim 2, wherein the orbiting scroll includes a disc-shaped orbiting scroll end plate which is vertically disposed and spiral-shaped orbiting scroll wraps configured to protrude from one surface of the orbiting scroll end plate in a horizontal direction.

5. The motor driven compressor apparatus of claim 4, wherein the fixed scroll includes a disc-shaped fixed scroll end plate which is vertically disposed; a discharge port configured to pass through a center of the fixed scroll end plate from one surface to the other surface; a valve disposed on one cross section of the fixed scroll end plate to selectively open and close the discharge port; a wall configured to protrude to an outer circumferential surface in the other surface direction of the fixed scroll end plate in a horizontal direction; and spiral-shaped fixed scroll wraps configured to protrude from the other surface of the fixed scroll end plate in a horizontal direction to be alternately inserted into the orbiting scroll wraps at an angle of 180°.

6. The motor driven compressor apparatus of claim 5, comprising compressing chambers formed to be surrounded by the orbiting scroll end plate, the orbiting scroll wraps, the fixed scroll end plate, and the fixed scroll wraps and in which the refrigerant and oil are compressed by rotation of the orbiting scroll.

7. The motor driven compressor apparatus of claim 6, wherein:

a first refrigerant collecting hole configured to allow one surface of the center plate and the back pressure chamber to communicate with each other is formed in the center plate; and a second refrigerant collecting hole, which is formed between the discharge chamber disposed in one end direction of the fixed scroll and the first refrigerant collecting hole to allow the discharge chamber and the first refrigerant collecting hole to communicate with each other, is formed in the wall.

8. A motor driven compressor apparatus comprising:

a housing having a suction chamber into which a refrigerant is introduced and a discharge chamber from which the introduced refrigerant is compressed and discharged;

a center plate fixed to an inside of the housing;

a driving part fixed to the inside of the housing and configured to generate rotating power;

a rotary shaft rotatably supported in the housing to rotate by the rotating power of the driving part;

a swing pin configured to connect an eccentric bushing and the rotary shaft;

the eccentric bushing eccentrically coupled to the rotary shaft and configured to orbit an orbiting scroll;

the orbiting scroll disposed in one direction of the eccentric bushing and orbited by the rotary shaft;

a fixed scroll disposed in one direction of the orbiting scroll and in which the orbiting scroll orbits therein;

a flow path formed in the rotary shaft, which passes through a center in a cross section in a longitudinal direction and bends within the rotary shaft;

a first pin insertion hole, which forms the flow path in one direction at which the eccentric bushing is disposed and into which the swing pin is inserted;

a second pin insertion hole, into which the swing pin is inserted, is formed in the eccentric bushing in the other direction at which the rotary shaft is disposed, and the refrigerant leaks between the swing pin and the first pin insertion hole, wherein an outer diameter of the swing pin is formed to be the same as an inner diameter of the first pin insertion hole and less than an inner diameter of the second pin insertion hole, and thus an outer circumferential surface of the swing pin in the one direction comes into surface contact with an inner circumferential surface of the first pin insertion hole, an outer circumferential surface in the other direction is slidably coupled to the second pin insertion hole, and the swing pin has a pin flow path groove formed therein along a longitudinal direction thereof.

* * * * *